US010481558B2

(12) United States Patent
Robinson

(10) Patent No.: US 10,481,558 B2
(45) Date of Patent: Nov. 19, 2019

(54) WRIST WEARABLE DEVICE REPOSITIONING ASSEMBLY

(71) Applicant: Blake Robinson, Carson City, NV (US)

(72) Inventor: Blake Robinson, Carson City, NV (US)

( * ) Notice: Subject to any disclaimer, the term of this patent is extended or adjusted under 35 U.S.C. 154(b) by 0 days.

(21) Appl. No.: 15/970,983

(22) Filed: May 4, 2018

(65) Prior Publication Data

US 2019/0049902 A1 Feb. 14, 2019

Related U.S. Application Data

(60) Provisional application No. 62/545,354, filed on Aug. 14, 2017.

(51) Int. Cl.

| | |
|---|---|
| ***G04B 37/18*** | (2006.01) |
| ***G04B 37/05*** | (2006.01) |
| ***A44C 5/00*** | (2006.01) |
| ***G04B 37/14*** | (2006.01) |
| *G04B 37/12* | (2006.01) |

(52) U.S. Cl.

CPC ..... *G04B 37/18* (2013.01); *A44C 5/0007* (2013.01); *A44C 5/0053* (2013.01); *G04B 37/05* (2013.01); *G04B 37/1486* (2013.01); *A44C 5/00* (2013.01); *G04B 37/127* (2013.01)

(58) Field of Classification Search

CPC ..... A44C 5/0007; A44C 5/0053; A44C 5/00; B04B 37/18; B04B 37/05; B04B 37/127; G04B 37/18; G04B 37/05; G04B 37/127

USPC ..... 224/171

See application file for complete search history.

(56) References Cited

U.S. PATENT DOCUMENTS

| | | | | |
|---|---|---|---|---|
| 2005/0121562 | A1* | 6/2005 | Baumgardner | A47B 21/0371 248/118.1 |
| 2006/0226305 | A1* | 10/2006 | Sheybani | A61F 5/0118 248/118.5 |
| 2010/0323154 | A1* | 12/2010 | Sharobiem | A44C 5/00 428/131 |
| 2016/0198815 | A1* | 7/2016 | Oefelein | A41D 13/088 248/118 |

* cited by examiner

*Primary Examiner* — Corey N Skurdal

(57) ABSTRACT

A wrist wearable device repositioning assembly for relocating a front face of a wrist wearable device on a wrist includes a recess that is positioned in a bottom of a block to define a pair of arms. The recess is configured to insert a wrist of a user. The arms position a top of the block on a side of the wrist. The block is pliable so that the block is configured to conform to contours of the wrist that is positioned in the recess. A coupler is coupled to the top of the block and is configured to couple the block to a back face of a wrist wearable device. Coupling of a band of the wrist wearable device to the wrist fixedly positions the block and a front face of the wrist wearable device on the side of the wrist.

16 Claims, 4 Drawing Sheets

WRIST WEARABLE DEVICE REPOSITIONING ASSEMBLY

CROSS-REFERENCE TO RELATED APPLICATIONS

I hereby claim the benefit under 35 U.S.C. Section 119(e) of U.S. Provisional application 62/545,354 Filed Aug. 17, 2017

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to repositioning assemblies and more particularly pertains to a new repositioning assembly for relocating a front face of a wrist wearable device on a wrist.

BRIEF SUMMARY OF THE INVENTION

An embodiment of the disclosure meets the needs presented above by generally comprising a recess that is positioned in a bottom of a block to define a pair of arms. The recess is configured to insert a wrist of a user. The arms position a top of the block on a side of the wrist. The block is pliable so that the block is configured to conform to contours of the wrist that is positioned in the recess. A coupler is coupled to the top of the block and is configured to couple the block to a back face of a wrist wearable device. Coupling of a band of the wrist wearable device to the wrist fixedly positions the block and a front face of the wrist wearable device on the side of the wrist.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
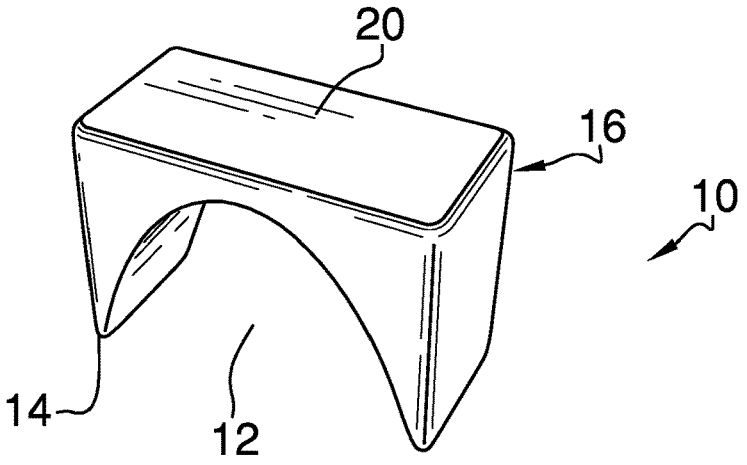
FIG. 1 is an isometric perspective view of a wrist wearable device repositioning assembly according to an embodiment of the disclosure.

With reference now to the drawings, and in particular to FIGS. 1 through 8 thereof, a new repositioning assembly embodying the principles and concepts of an embodiment of the disclosure and generally designated by the reference numeral 10 will be described.

As best illustrated in FIGS. 1 through 8, the wrist wearable device repositioning assembly 10 generally comprises a recess 12 that is positioned in a bottom 14 of a block 16 to define a pair of arms 18. The recess 12 is configured to insert a wrist of a user. The arms 18 position a top 20 of the block 16 on a side of the wrist. The block 16 is pliable so that the block 16 is configured to conform to contours of the wrist that is positioned in the recess 12. The block 16 comprises foam, rubber, or the like.

Figure 2:
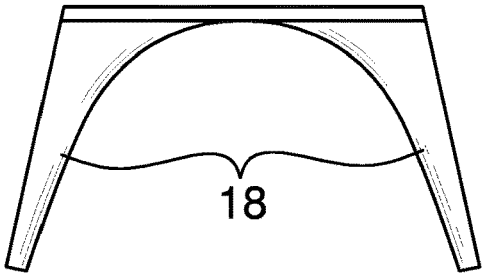
FIG. 2 is a front view of an embodiment of the disclosure.
Figure 3:
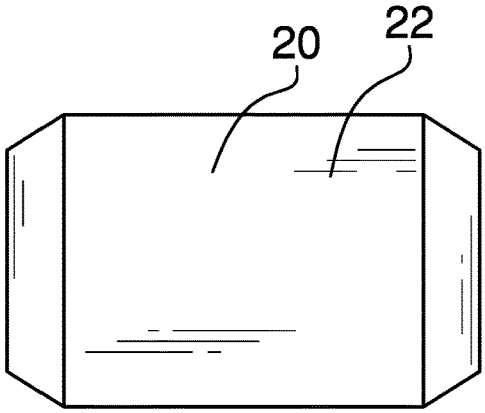
FIG. 3 is a top view of an embodiment of the disclosure.
Figure 4:
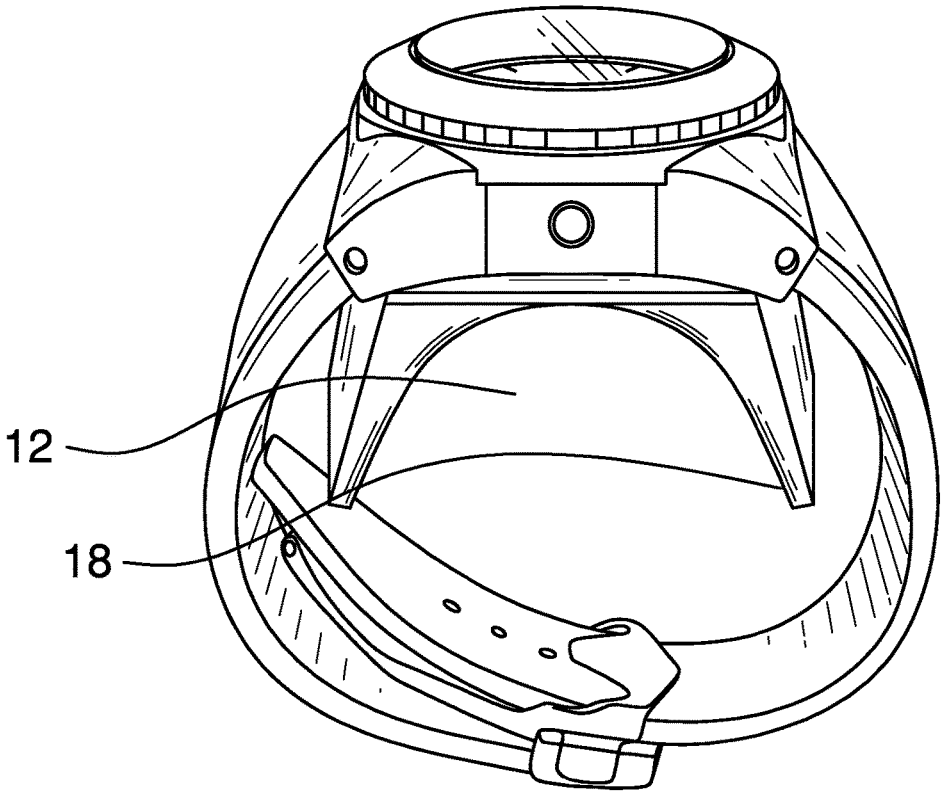
FIG. 4 is an isometric perspective view of an embodiment of the disclosure.
Figure 5:
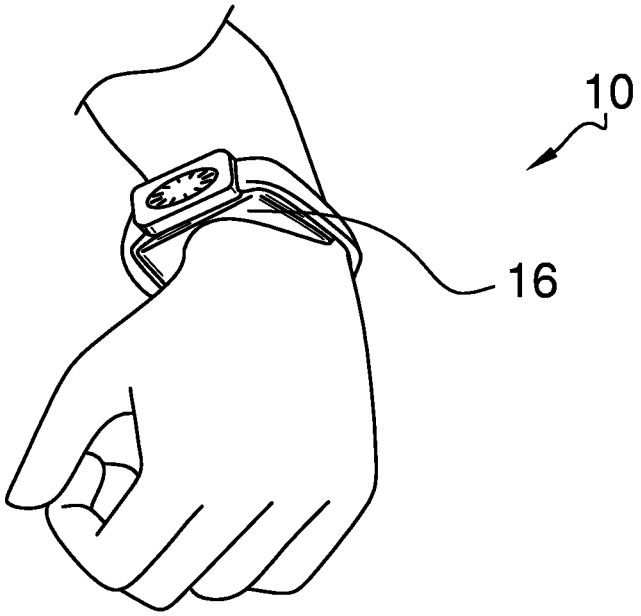
FIG. 5 is an in-use view of an embodiment of the disclosure.

The top 20 of the block 16 is substantially rectangularly shaped, as shown in FIG. 3. The top 20 is circumferentially smaller than the bottom 14 of the block 16 so that the arms 18 extend transversely from the top 20, as shown in FIG. 2.

A coupler 22 is coupled to the top 20 of the block 16. The coupler 22 comprises adhesive or the like. The coupler 22 is configured to couple the block 16 to a back face of a wrist wearable device, such as a watch, smartwatch, compass, depth gauge, or the like. Coupling of a band of the wrist wearable device to the wrist fixedly positions the block 16 and a front face of the wrist wearable device on the side of the wrist. With the front face of the device repositioned to the side of the wrist, the user is not required to turn the wrist to view the front face. This configuration assists in preventing the front face from being viewed by a person positioned proximate the user.

Figure 7:
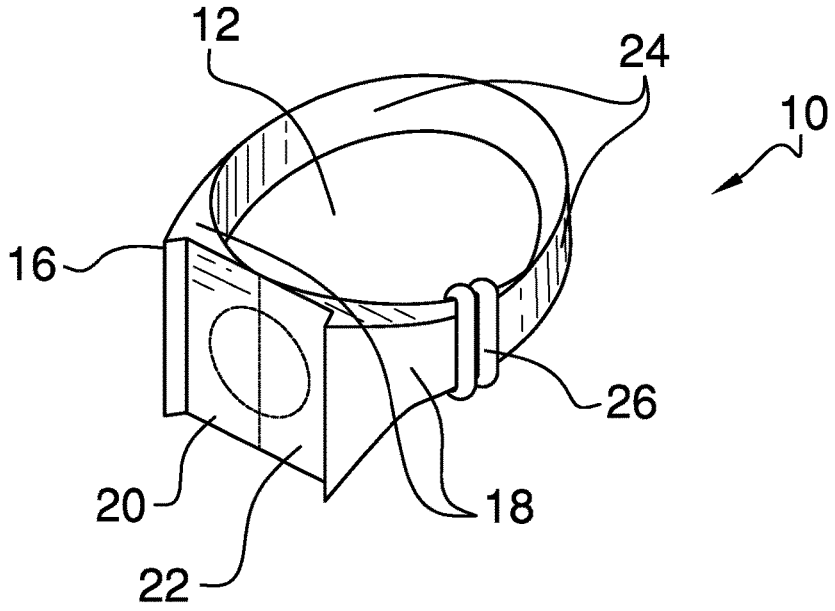
FIG. 7 is an isometric perspective view of an embodiment of the disclosure.

In another embodiment, as shown in FIG. 7, each of a pair of straps 24 is coupled to and extends from a respective arm 18 distal from the top 20 of the block 16. The straps 24 are selectively mutually couplable. The recess 12 is configured to insert the wrist of the user to position the top 20 of the block 16 on the side of the wrist. The straps 24 are configured to loopedly position around the wrist of the user, positioning the straps 24 to be mutually coupled so that the block 16 is coupled to the wrist.

A loop 26 is positioned around and frictionally coupled to the pair of straps 24, as shown in FIG. 7. The loop 26 is pliable so that the loop 26 is configured to be stretched to allow adjustment of the pair of straps 24 and to rebound to fixedly position the pair of straps 24.

Figure 8:
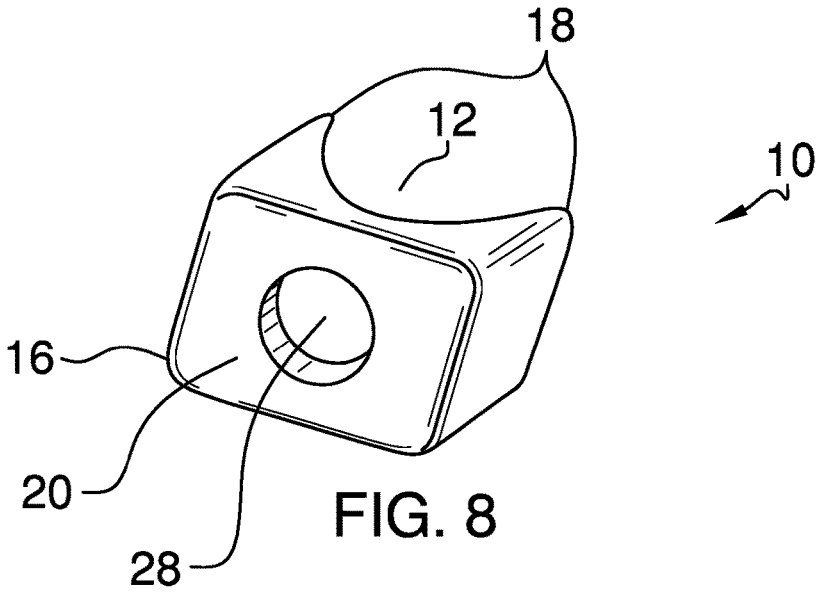
FIG. 8 is an isometric perspective view of an embodiment of the disclosure.

In yet another embodiment, as shown in FIG. 8, a channel 28 extends through the block 16 from the top 20 to the recess 12. The channel 28 is centrally positioned in the top 20. The channel 28 is configured to insert a sensor that is operationally coupled to the wrist wearable device so that the sensor contacts skin of the user to assess a biological parameter.

Figure 6:
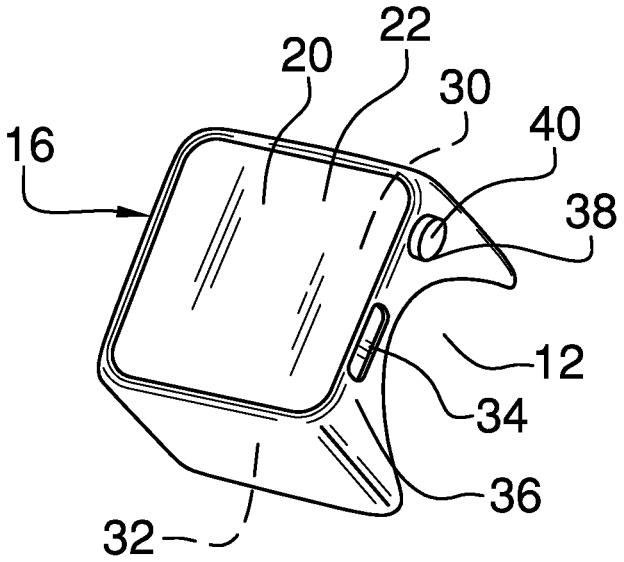
FIG. 6 is an isometric perspective view of an embodiment of the disclosure.

In another embodiment, as shown in FIG. 6, a power module 30 is coupled to and is positioned in the block 16. The power module 30 comprises a battery 32. A bulb 34 is coupled to a front 36 of the block 16 proximate to the top 20. The bulb 34 is infrared emitting. A controller 38 is coupled to the block 16 proximate to the bulb 34. The controller 38 is operationally coupled to the power module 30 and the bulb 34. The controller 38 is positioned to selectively couple the power module 30 to the bulb 34 to power the bulb 34 to illuminate an area proximate to the block 16.

The controller 38 comprises a button 40 that is depressible. The button 40 is configured to be depressed a first time to couple the bulb 34 to the power module 30 and to be depressed a second time to decouple the bulb 34 from the power module 30.

In use, the coupler 22 is used to couple the block 16 to the back face of the wrist wearable device. The wrist of the user is inserted into the recess 12. Coupling of the band of the wrist wearable device to the wrist fixedly positions the block 16 and the front face of the wrist wearable device on the side of the wrist.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wrist wearable device repositioning assembly comprising:

a block;

a recess positioned in a bottom of said block defining a pair of arms wherein said recess is configured for inserting a wrist of a user such that said arms position a top of said block on a side of the wrist wherein said block is pliable such that said block is configured for conforming to contours of the wrist positioned in said recess; and a coupler coupled to said top of said block wherein said coupler is configured for coupling said block to a back face of a wrist wearable device wherein coupling of a band of the wrist wearable device to the wrist fixedly positions said block and a front face of the wrist wearable device on the side of the wrist; and a channel extending through said block from said top to said recess wherein said channel is configured for inserting a sensor operationally coupled to the wrist wearable device such that the sensor contacts skin of the user for assessing a biological parameter.

2. The assembly of claim 1, further including said block comprising foam.

3. The assembly of claim 1, further including said block comprising rubber.

4. The assembly of claim 1, further including said top being substantially rectangularly shaped.

5. The assembly of claim 4, further including said top being circumferentially smaller than said bottom of said block such that said arms extend transversely from said top.

6. The assembly of claim 1, further including said coupler comprising adhesive.

7. The assembly of claim 1, further including a pair of straps, each said strap being coupled to and extending from a respective said arm distal from said top of said block, said straps being selectively mutually couplable wherein said recess is configured for inserting the wrist of the user positioning said top of said block on the side of the wrist wherein said straps are configured for loopedly positioning around the wrist of the user positioning said straps for mutually coupling such that said block is coupled to the wrist.

8. The assembly of claim 7, further including a loop positioned around and frictionally coupled to said pair of straps, said loop being pliable wherein said loop is configured for stretching for allowing adjustment of said pair of straps and for rebounding for fixedly positioning said pair of straps.

9. The assembly of claim 1, further including said channel being centrally positioned in said top.

10. A wrist wearable device repositioning assembly comprising:

a block;

a recess positioned in a bottom of said block defining a pair of arms wherein said recess is configured for inserting a wrist of a user such that said arms position a top of said block on a side of the wrist wherein said block is pliable such that said block is configured for conforming to contours of the wrist positioned in said recess;

a coupler coupled to said top of said block wherein said coupler is configured for coupling said block to a back face of a wrist wearable device wherein coupling of a band of the wrist wearable device to the wrist fixedly positions said block and a front face of the wrist wearable device on the side of the wrist;

a power module coupled to and positioned in said block;

a bulb coupled to a front of said block proximate to said top; and a controller coupled to said block proximate to said bulb, said controller being operationally coupled to said power module and said bulb wherein said controller is positioned for selectively coupling said power module to said bulb for powering said bulb for illuminating an area proximate to said block.

11. The assembly of claim 10, further including said power module comprising a battery.

12. The assembly of claim 10, further including said bulb being infrared emitting.

13. The assembly of claim 10, further including said controller comprising a button, said button being depressible, wherein said button is configured for depressing a first time for coupling said bulb to said power module and for depressing a second time for decoupling said bulb from said power module.

14. A wrist wearable device repositioning assembly comprising:

a block;

a recess positioned in a bottom of said block defining a pair of arms wherein said recess is configured for inserting a wrist of a user such that said arms position a top of said block on a side of the wrist wherein said block is pliable such that said block is configured for conforming to contours of the wrist positioned in said recess, said top being substantially rectangularly shaped, said top being circumferentially smaller than said bottom of said block such that said arms extend transversely from said top;

a coupler coupled to said top of said block wherein said coupler is configured for coupling said block to a back face of a wrist wearable device wherein coupling of a band of the wrist wearable device to the wrist fixedly positions said block and a front face of the wrist wearable device on the side of the wrist, said coupler comprising adhesive;

a pair of straps, each said strap being coupled to and extending from a respective said arm distal from said top of said block, said straps being selectively mutually couplable wherein said recess is configured for inserting the wrist of the user positioning said top of said block on the side of the wrist wherein said straps are configured for loopedly positioning around the wrist of the user positioning said straps for mutually coupling such that said block is coupled to the wrist;

a loop positioned around and frictionally coupled to said pair of straps, said loop being pliable wherein said loop is configured for stretching for allowing adjustment of said pair of straps and for rebounding for fixedly positioning said pair of straps;

a channel extending through said block from said top to said recess wherein said channel is configured for inserting a sensor operationally coupled to the wrist wearable device such that the sensor contacts skin of the user for assessing a biological parameter, said channel being centrally positioned in said top;

a power module coupled to and positioned in said block, said power module comprising a battery;

a bulb coupled to a front of said block proximate to said top, said bulb being infrared emitting; and a controller coupled to said block proximate to said bulb, said controller being operationally coupled to said power module and said bulb wherein said controller is positioned for selectively coupling said power module to said bulb for powering said bulb for illuminating an area proximate to said block, said controller comprising a button, said button being depressible, wherein said button is configured for depressing a first time for coupling said bulb to said power module and for depressing a second time for decoupling said bulb from said power module.

15. The assembly of claim 14, further including said block comprising foam.

16. The assembly of claim 14, further including said block comprising rubber.

* * * * *